US008209788B2

(12) United States Patent
Takamine et al.

(10) Patent No.: US 8,209,788 B2
(45) Date of Patent: Jul. 3, 2012

(54) CHEMICAL SOLUTION DISTRIBUTING APPARATUS AND CHEMICALS

(75) Inventors: Michio Takamine, Hanyu (JP); Hideo Takada, Isumi-gun (JP)

(73) Assignee: Nippon Soda Co., Ltd., Tokyo (JP)

( * ) Notice: Subject to any disclaimer, the term of this patent is extended or adjusted under 35 U.S.C. 154(b) by 1392 days.

(21) Appl. No.: 11/813,663

(22) PCT Filed: Jan. 19, 2006

(86) PCT No.: PCT/JP2006/300724

§ 371 (c)(1),
(2), (4) Date: Jul. 10, 2007

(87) PCT Pub. No.: WO2006/077917

PCT Pub. Date: Jul. 27, 2006

(65) Prior Publication Data

US 2009/0019625 A1 Jan. 22, 2009

(30) Foreign Application Priority Data

Jan. 20, 2005 (JP) ..... 2005-013178
Jul. 29, 2005 (JP) ..... 2005-220865
Aug. 31, 2005 (JP) ..... 2005-250575

(51) Int. Cl.
*E03D 9/02* (2006.01)

(52) U.S. Cl. ..... 4/227.1

(58) Field of Classification Search ..... 4/227.1–227.6, 4/222

See application file for complete search history.

(56) References Cited

U.S. PATENT DOCUMENTS 4,307,474 A 12/1981 Choy
4,635,302 A * 1/1987 Dolan ..... 4/227.6
6,003,161 A * 12/1999 Tomaini ..... 4/415
6,505,356 B1 * 1/2003 Leonard et al. ..... 4/231
8,046,848 B2 * 11/2011 Birbara et al. ..... 4/144.1

FOREIGN PATENT DOCUMENTS

CN 1064620 A 9/1992

(Continued)

OTHER PUBLICATIONS

Oct. 21, 2009 Notice of Allowance issued in Taiwanese Patent Application No. 095112929 with English translation.

(Continued)

*Primary Examiner* — Lori Baker
(74) *Attorney, Agent, or Firm* — Oliff & Berridge, PLC

(57) ABSTRACT

A chemical solution distributing apparatus which is installed in a water tank in water closets or the like and distributes chemical solutions periodically in the water tank including a bottomed tubular apparatus main body which has an opening at its lower end; a chemical retaining section which is present inside this apparatus main body and mounts/retains chemicals; and a drawn-water passage section which is installed outside the apparatus main body and in which one end thereof is connected to the inside of the apparatus main body via the opening while the other end thereof is positioned higher than the lower end of the apparatus main body; wherein the chemical retaining section has holes in order to mix chemicals with the water inside the apparatus main body or inside the water tank; and wherein a check valve to allow release of air inside the apparatus main body to the outside is also formed.

12 Claims, 9 Drawing Sheets

FOREIGN PATENT DOCUMENTS

| | | | | |
|---|---|---|---|---|
| CN | 2172314 | Y | * | 7/1994 |
| CN | A 1299863 | | | 6/2001 |
| DE | 39 41 253 | A1 | | 8/1991 |
| FR | 2 554 145 | A1 | | 5/1985 |
| JP | 53-115544 | A | | 10/1978 |
| JP | 62-248725 | A | | 10/1987 |
| JP | 5-321314 | A | | 12/1993 |
| JP | 6-30284 | U | | 4/1994 |
| JP | 2005-061129 | A | | 3/2005 |
| TW | 310738 | | | 7/1997 |
| WO | WO 2004/016869 | | * | 2/2004 |
| WO | WO 2004/016869 | A1 | | 2/2004 |

OTHER PUBLICATIONS

Nov. 2, 2010 Supplementary European Search Report issued in European Patent Application No. 06711970.01.

Apr. 21, 2011 Canadian Office Action issued in Canadian Application No. 2,689,911.

Jun. 24, 2011 First Office Action issued in Chinese Application No. 200910215646.0 with English-language translation.

* cited by examiner

CHEMICAL SOLUTION DISTRIBUTING APPARATUS AND CHEMICALS

CROSS REFERENCE TO RELATED APPLICATIONS

This is a U.S. national phase application under 35 U.S.C. §371 of International Patent Application No. PCT/JP2006/300724, filed Jan. 19, 2006, which claims the benefit of Japanese Patent Application Nos. 2005-013178, filed Jan. 20, 2005, 2005-220865, filed Jul. 29, 2005, 2005-250575, filed Aug. 31, 2005, all of which are incorporated by reference herein. The International Application was published in Japanese on Jul. 27, 2006 as International Publication No. WO 2006/077917 under PCT Article 21(2).

TECHNICAL FIELD

The present invention relates to a chemical solution distributing apparatus which is set inside a water tank such as a flush tank in a water closet and which regularly distributes chemical solutions into water inside the water tank.

BACKGROUND ART

The water stored in the water tank of a water closet is flushed into toilets or urinals every time they are used and flows through the entire inner surface thereof. Many chemical solution distributing apparatuses for distributing chemical solutions into the water in water tanks periodically and at a fixed amount to clean toilets or urinals every time water is flushed have been proposed.

For example, an apparatus which has the following configuration is known (e.g. refer to Patent document 1). A tubular and bottomed main body part which opens at a lower part thereof is set inside a water tank so that the opening at the lower end is positioned above the water surface in a condition where the water in the water tank is drained. At the same time, a chemical solution tank where chemical solutions are stored is installed outside the water tank; a liquid-drawing tube one end of which is opened at the upper part of the main body part while the other end is submerged in the chemical solutions in the chemical solution tank is provided; and moreover, a check valve which releases the air inside the main body to the outside is installed at the top surface of the main body part.

In this apparatus, when water is added to the water tank to raise the water level therein, water enters the main body from the opening at the lower end of the main body part and also raises the water level inside the main body part while releasing air inside the main body to the outside via a check valve. When the water inside the water tank is drained, the water level inside the water tank drops and the water level inside the main body part also nearly drops. However, since it is not possible to aspirate air from the outside to the inside of the main body part due to the action of the check valve, the pressure in the upper space part inside the main body part becomes negative. Then chemical solutions inside a chemical solution tank are drawn into the main body part via the liquid-drawing tube. The drawn chemical solutions drop into the inside of the main body and drip into the water inside the main body. When the water level outside the main body part becomes lower than the level of the opening at the lower end of the main body part, air flows into the main body part from the opening and the drawing of chemical solutions via the liquid-drawing tube stops. The above processes are repeated regularly every time water is supplied to or drained from the water tank and an almost constant amount of chemical solutions are drawn into the main body side from a chemical solution tank each time.

Additionally, an apparatus which has the following configuration is known (e.g. refer to Patent document 2). Inside a container which opens at its lower end and which is cup-shaped, a water-storage tank section where chemicals, which dissolve in water to generate chemical solutions, are retained and which also has an opening close to the lower end of this cup-shaped container is provided integral to the container so as to be placed at an upper part of the container. The container and water-storage tank are installed in the apparatus so as to be submerged completely inside a water tank.

In this apparatus, air vent holes are provided in the water-storage tank and when the water level inside the water tank rises, although water does not enter inside the cup-shaped container and thus chemicals are not submerged, air is ejected from the air vent holes and the water-storage tank is filled with water. When the water inside the water tank is drained and the water level therein drops, the water inside the water-storage tank section is jetted into the inside of the container from the opening due to gravitational force. By setting the position and direction of the opening so that the chemicals receive the jetted water, part of chemicals is dissolved and chemical solutions drip into the water tank.

Patent document 1: Utility Model Laid-Open Application No. Hei 6-30284 (FIGS. 1 to 4)

Patent document 2: Japanese Unexamined Patent Application, First Publication No. Sho 62-248725 (FIGS. 5 to 8)

DISCLOSURE OF THE INVENTION

Problems to be Solved by the Invention

With the apparatus described in the abovementioned Patent document 1, the chemical solution inside the chemical solution tank which is placed outside a water tank is drawn into the water tank as the water level inside the water tank drops and this drawing of the chemical solution continues until the water level in the water tank drops to a lower position than that of an opening at the lower end of the main body part. For this reason, a relatively large amount of chemical solutions is drawn into the water tank with one drawing. Accordingly, unless the capacity of the chemical solution tank which is placed outside the water tank is made considerably large, deficiencies occur; i.e. chemical solutions must be supplied constantly within a short period of time or a large chemical solution tank has to be installed. Note that if the concentration of chemical solutions is increased in order to decrease the amount of chemical solutions being drawn at one time, the concentration of chemical solutions after being mixed with water in the water tank varies unless the drawing amount of chemical solutions is accurately set, and moreover, new deficiencies occur; i.e. the rate of decrease in the amount of chemical solutions in the chemical solution tank varies. Furthermore, since the main body part has to be located inside the water tank and the chemical solution tank has to be located outside the water tank, deficiencies also occur; i.e. the entire apparatus needs to be increased in size and also becomes more complex.

With the apparatus described in the abovementioned Patent document 2, although a container, in which air remains all the time, is always submerged completely and thus buoyancy is given to the container, since this container is positioned below a water storage tank, it is possible for the container to be inverted due to the buoyancy if it is not fixed in the water tank completely. Moreover, since the water storage tank cannot be set that high relative to the container, it is difficult to strengthen the jetting of water from the water storage tank to chemicals, and thus it is difficult for chemicals to receive water stably.

The object of the present invention is, in view of the abovementioned problems, to provide a chemical solution distributing apparatus which is capable of solving the deficiencies described above and stably distributing chemical solutions into a water tank, and also to provide chemicals which are favorable for this chemical solution distributing apparatus.

Means for Solving the Problem

In order to solve the abovementioned problems, the chemical solution distributing apparatus of the present invention is characterized by the following features. The apparatus is installed in the water tank of a water closet or the like and distributes chemical solutions into the water tank periodically. The apparatus has a bottomed tubular apparatus main body which opens at its lower end; a chemical retaining section which is disposed inside this apparatus main body and mounts/retains chemicals at a predetermined height from the opening at the lower end; and a drawn-water passage section in which one end thereof is positioned higher than the chemical retaining section and opens towards the inside of the apparatus main body and the other end thereof is outside the apparatus main body and positioned higher than the lower end of the apparatus main body. As the water level inside the apparatus main body drops, the water inside the drawn-water passage section is drawn into the top surface of the chemical retaining section to dissolve chemicals in the water to form chemical solutions, and holes are provided below the chemical retaining section as dropping outlets from which the chemical solutions are dropped in order to mix the chemical solutions with the water inside the apparatus main body or inside the water tank. Additionally, means to allow the release of air from the inside of the apparatus main body to the outside in the form of a check valve is also provided at an upper part of the apparatus main body.

In the abovementioned configuration, when the water inside the water tank is drained, the water inside the apparatus main body and inside the drawn-water passage section cannot move, and thus a high water level is maintained until the water level inside the water tank drops to the lower-end position of the drawn-water passage section. Since the opening at the lower end of the drawn-water passage section is exposed to air when the water level inside the water tank becomes lower than the lower end of the drawn-water passage section, the water inside the apparatus main body part drops all at once while the opening at the lower end of the drawn-water passage section is drawing in air. The water which was filling inside the drawn-water passage section is drawn into the apparatus main body together with the air which is drawn from the opening at the lower end of the drawn-water passage section. Since this drawn water spreads on the chemical retaining section, it infiltrates to the bottom surface of the chemical and a solution thereof is generated. This solution is then dropped into the water inside the water tank by passing through a dropping outlet.

Additionally, in the case where a solid chemical is mounted on the chemical retaining section while being uncovered, when the side surface of the chemical receives the water inside the drawn-water passage section, the chemical starts to dissolve at a portion at which water is received and the total mass thereof does not reduce evenly. In that case, it is desirable to form a guard section positioned between the opening of the abovementioned drawn-water passage section and chemical which prevents the side surface of the chemical from receiving water jetted from this opening. When water hits this guard section, it slowly spreads in the top surface of the chemical retaining section and dissolves the bottom surface of the chemical evenly.

Particularly, when space forming means is provided which forms a space between the top surface of the abovementioned chemical retaining section and chemical for distributing the water which is drawn from the drawn-water passage section to the entire bottom surface of the chemical, it is possible to further reliably dissolve the bottom surface of the chemical evenly.

Note that it is also possible to make the upper end of the abovementioned apparatus main body a lid portion which is freely attachable/detachable so that the supply of chemicals can be carried out by dismounting this lid portion.

In addition, when the apparatus main body is configured so that air fresheners are mounted above the chemical retaining section, air containing fragrance is emitted from the air fresheners every time the air inside the apparatus main body is replaced.

For the chemicals used in the abovementioned chemical solution distributing apparatus, necessary substances such as surfactants, perfumes, pigments, bactericides, antimicrobial agents, and antifungal agents may be used as components depending on purposes where appropriate.

Additionally, solid chemicals which are used in the abovementioned chemical solution distributing apparatus and which are formed from compacts containing particles of surfactants which are solid at normal temperatures, and solid acid are favorable as chemicals.

Effects of the Invention

As is apparent from the description so far, the present invention generates chemical solutions by dissolving chemicals in water supplied in a constant amount which is drawn via a drawn-water passage section, and thus large chemical solution tanks are not required, and moreover, the amount of water drawn towards the chemicals in one cycle can be adjusted by increasing/decreasing the volume of the drawn-water passage section so that the amount of chemical solutions generated at a time can be stabilized. Moreover, since the entire apparatus is not submerged in water completely, the apparatus as a whole can be installed in a water tank in a stable position with a relatively simple mounting structure.

BRIEF DESCRIPTION OF THE REFERENCE SYMBOLS

| | |
|---|---|
| 1 | Chemical solution distributing apparatus |
| 2 | Apparatus main body |
| 3 | Drawn-water passage tube |
| 4 | Lid body |
| 5 | Check valve |
| 6 | Chemical retaining section |
| 7 | Metal gauze |
| 8 | Chemical |
| 65 | Protrusion |

BEST MODES FOR CARRYING OUT THE INVENTION

Figure 1:
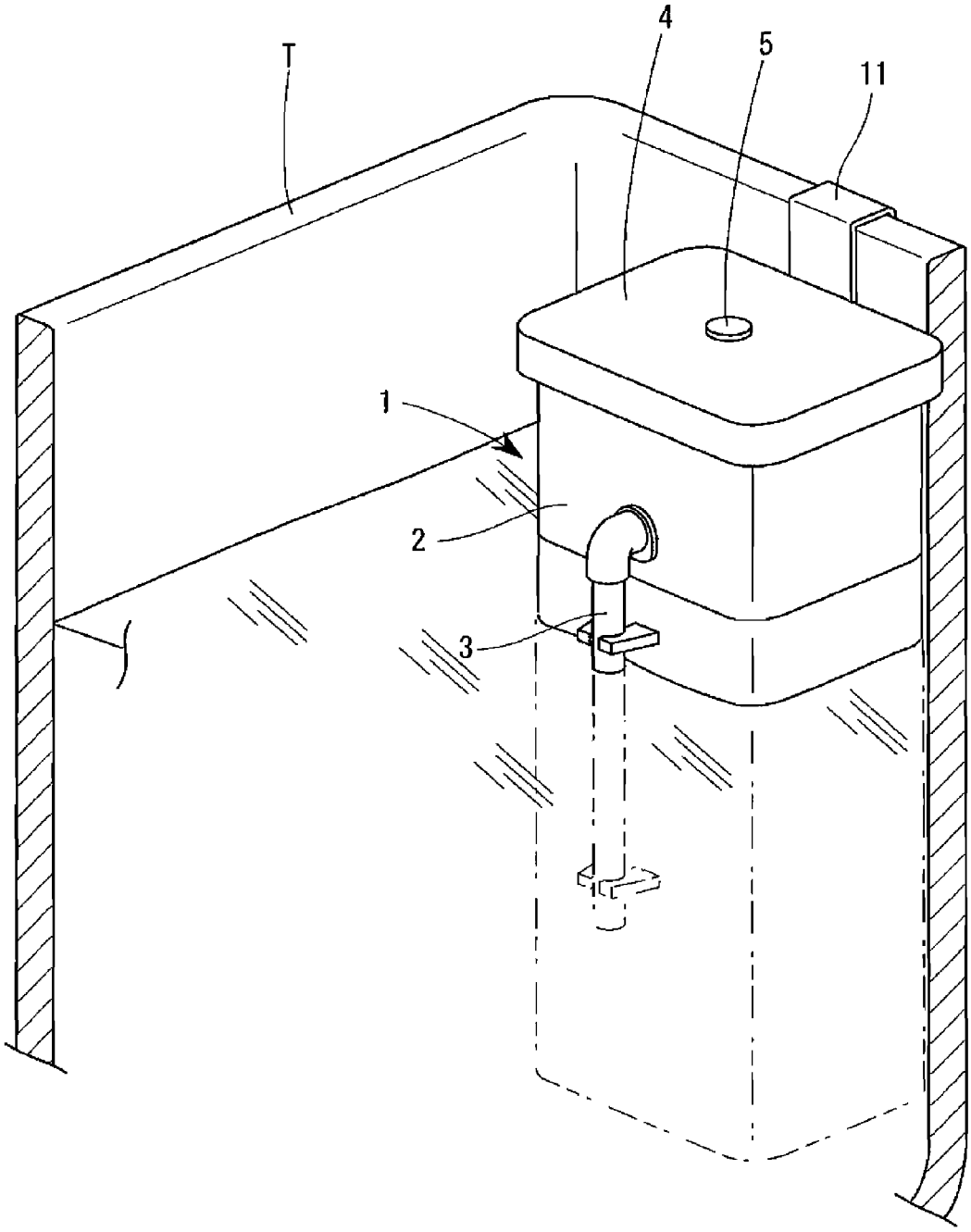
FIG. 1 is a diagram showing a configuration of one embodiment of the present invention.
Figure 2:
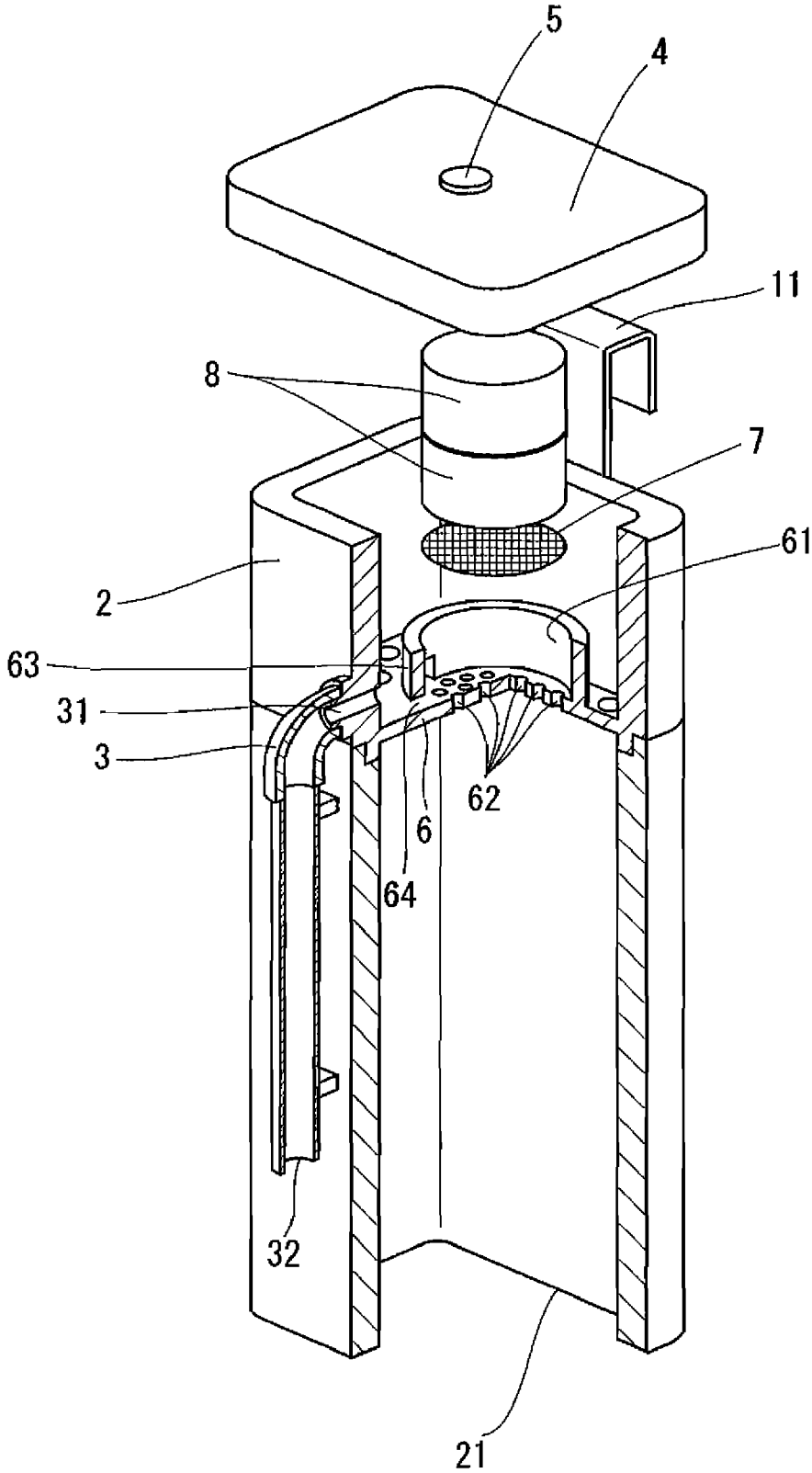
FIG. 2 is a cutaway perspective view showing a structure of the present apparatus.
Figure 3:
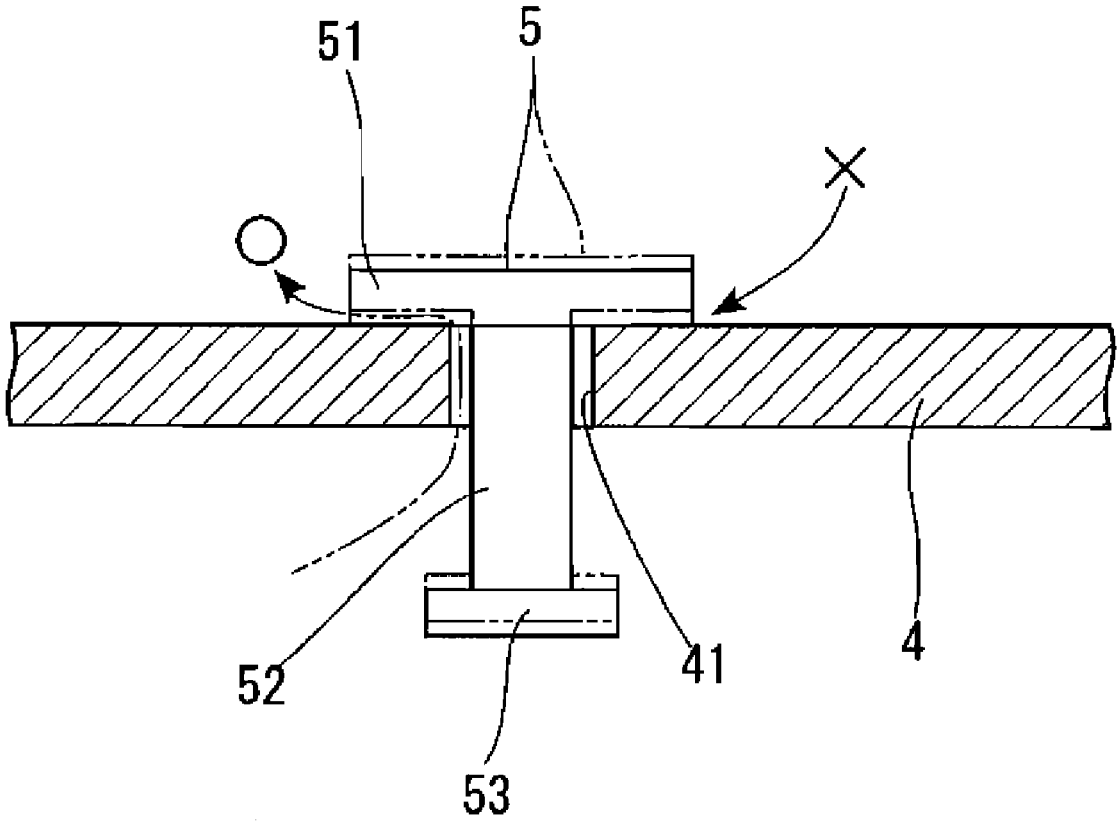
FIG. 3 is a diagram showing a structure of a check valve.

In FIGS. 1 and 2, numeral 1 shows a chemical solution distributing apparatus of the present invention. The present chemical solution distributing apparatus 1 has a tubular apparatus main body 2. Additionally, a lid body 4 is mounted on the upper end part of this apparatus main body 2 so that it is freely attachable/detachable and the apparatus main body 2 forms a bottomed tubular shape when the lid body 4 is mounted.

This apparatus main body 2 has a hook 11 on its outer face for installing and is set in a flush tank T, which is a water tank in a water closet, by hooking this hook 11 to the peripheral wall of the flush tank T. Note that the apparatus main body 2 is installed so that the opening 21 thereof opens facing downwards.

Inside the apparatus main body 2, a chemical retaining section 6 is provided which is positioned higher than the intermediate position thereof in the vertical direction and is kept level. A circular positioning section 61 is formed on the top surface of this chemical retaining section 6. A plurality of dropping outlets 62 are formed and positioned in and out of this positioning section 61. In the present embodiment, a metal gauze 7 is set inside the positioning section 61 and a chemical 8 is mounted on the metal gauze 7.

This metal gauze 7 is disposed for equally securing the space between the top surface of the chemical retaining section 6 and bottom surface of the chemical 8, and as described later, for equally distributing water over the entire bottom surface of the chemical 8 when the water is drawn into the top surface of the chemical retaining section 6.

The chemical 8 is formed of a compact which contains particles of a surfactant, which is solid at normal temperatures, and solid acid. Preferably, it is adjusted so that the concentration of the surfactant particles in the compact is 5 to 40 weight % and concentration of the solid acid in the compact is 40 to 95 weight %. As a surfactant, at least one kind of surfactant selected from the group consisting of an ethylene oxide-propylene oxide copolymer, a mixture of an ethylene oxide-propylene oxide copolymer and sorbitan monooleate, and a mixture of an ethylene oxide-propylene oxide copolymer and sodium dioctylsulfosuccinate, is used.

Examples of solid acids include fumaric acid, adipic acid, orthophthalic acid, succinic acid, maleic acid, methylene succinic acid, and boric acid. These solid acids are used alone or as mixtures of two or more kinds thereof.

In addition, pigments may be contained in order to color the dissolved chemicals. Benzyl-ethyl-[4'-(4"-(benzylethylamino)-diphenylmethylene)-2',5-cyclohexadienylidene]-ammonium-2"',3,3"'-trisulfonic disodium alone or mixtures thereof with other water-soluble pigments can be used as these pigments.

A nozzle 31 which opens above the chemical retaining section 6 is formed on the side wall of the apparatus main body 2. This nozzle 31 is connected to the drawn-water passage tube 3, which is attached outside the apparatus main body 2 and is pipe-shaped. An opening 32 which is at the lower end of this drawn-water passage tube 3 is set so as to be positioned above the opening 21 of the apparatus main body 2.

Additionally, the section which is a part of the positioning section 61 and which opposes the nozzle 31 functions as a guard section 63 and prevents the side of the chemical 8 from receiving water jetted from the nozzle 31. Moreover, a water-flowing window 64 is formed between this guard section 63 and the top surface of the chemical retaining section 6, and the water jetted from the nozzle 31 to hit the guard section 63 is spread over the entire bottom surface of the chemical 8 through this water-flowing window 64.

A check valve 5 is attached to the abovementioned lid body 4. This check valve 5 is fixed to an air vent hole 41, which is formed in the lid body 4, and is configured from a valve body section 51 which can cover the air vent hole 41 from above; a shank 52 which extends downwards from the center of the bottom surface of the valve body section 51; and a fastening section 53 which is formed at the lower end of the shank 52. Note that a gap is secured between this shank 52 and air vent hole 41 and when the internal pressure of the apparatus main body 2 gets higher than that of the surroundings while the lid body 4 is mounted on the upper part of the apparatus main body 2, the air inside the apparatus main body 2 passes through the air vent hole 41 to press up the valve body section 51 and then release to the outside. On the other hand, when the internal pressure of the apparatus main body 2 gets lower than that of the surroundings, the valve body section 51 acts to close the air vent hole 41 so that air is not drawn into the apparatus main body 2 from the outside.

Figure 4:
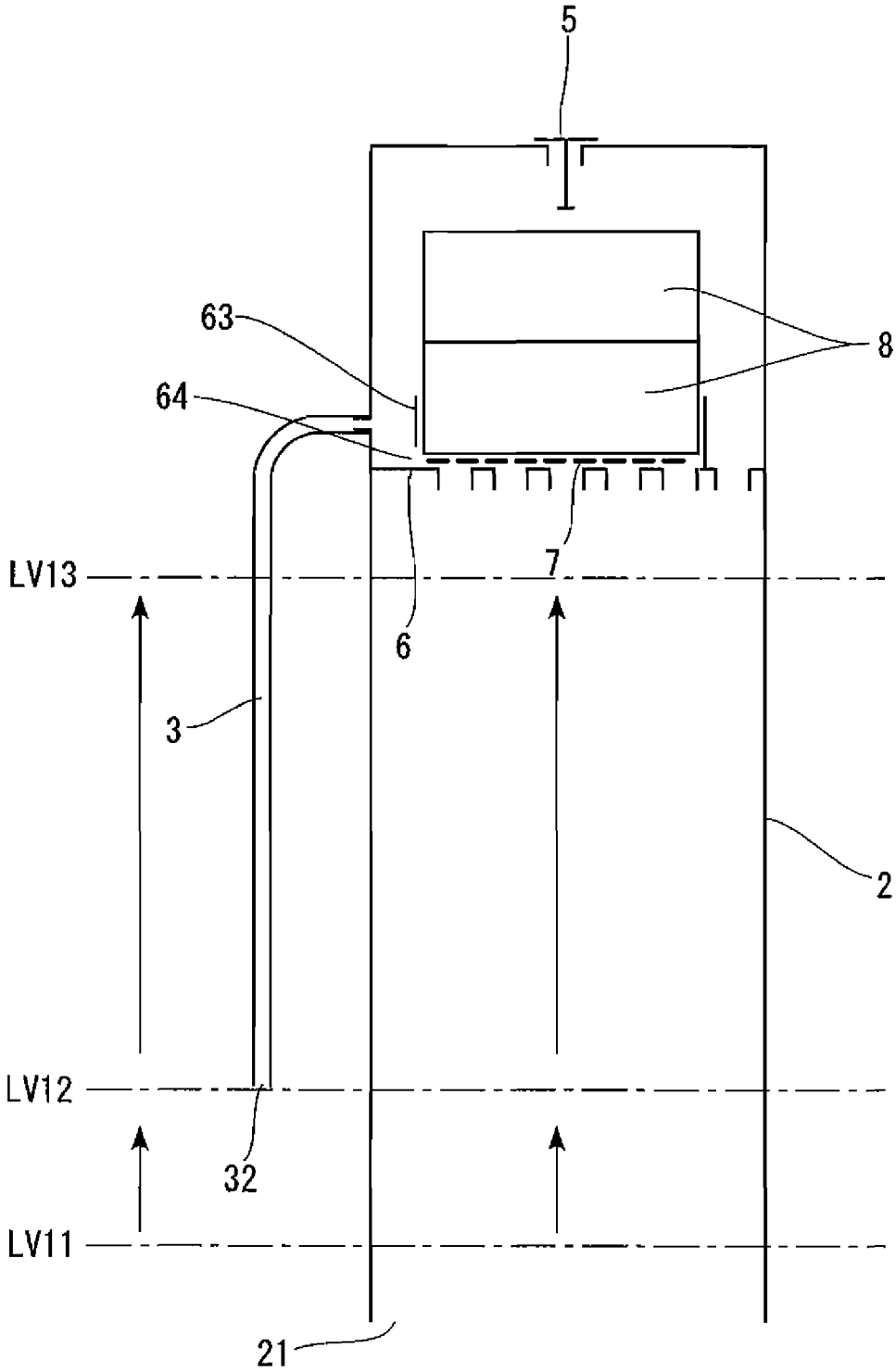
FIG. 4 is a diagram showing a process in which water level rises.

The process for adding water to the water tank T with the abovementioned configuration will be described by referring to FIG. 4. The water level in the water tank T is at the level LV11 immediately after drainage. When the addition of water is carried out from that state, water enters the apparatus main body 2 from the opening 21 and the air inside the apparatus main body 2 is discharged from the opening 32 through the drawn-water passage tube 3 as the water level rises until the water level reaches the same height as that of the opening 32 of the drawn-water passage tube 3, which is the level LV12. When the water level in the water tank T becomes higher than the level LV12, the air inside the apparatus main body 2 is discharged due to the opening of the check valve 5. When the water level in the water tank T reaches the level of LV13, which is the bankfull stage, the addition of water to the water tank T automatically stops. In that state, both the water level inside the apparatus main body 2 and water level inside the drawn-water passage tube 3 are almost the same as the level of LV13.

Figure 5:
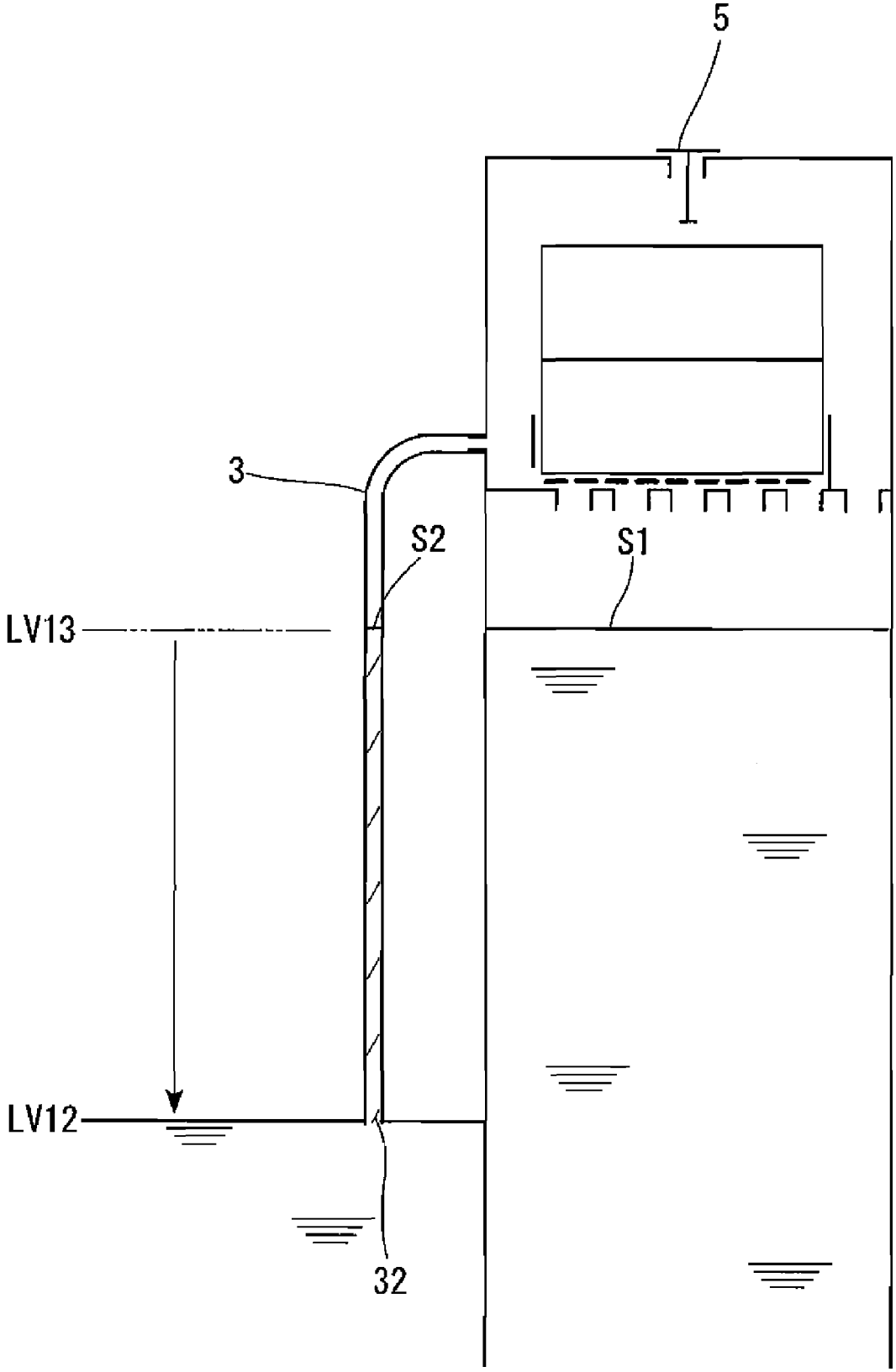
FIG. 5 is a diagram showing intermediate steps in which water level drops.
Figure 6:
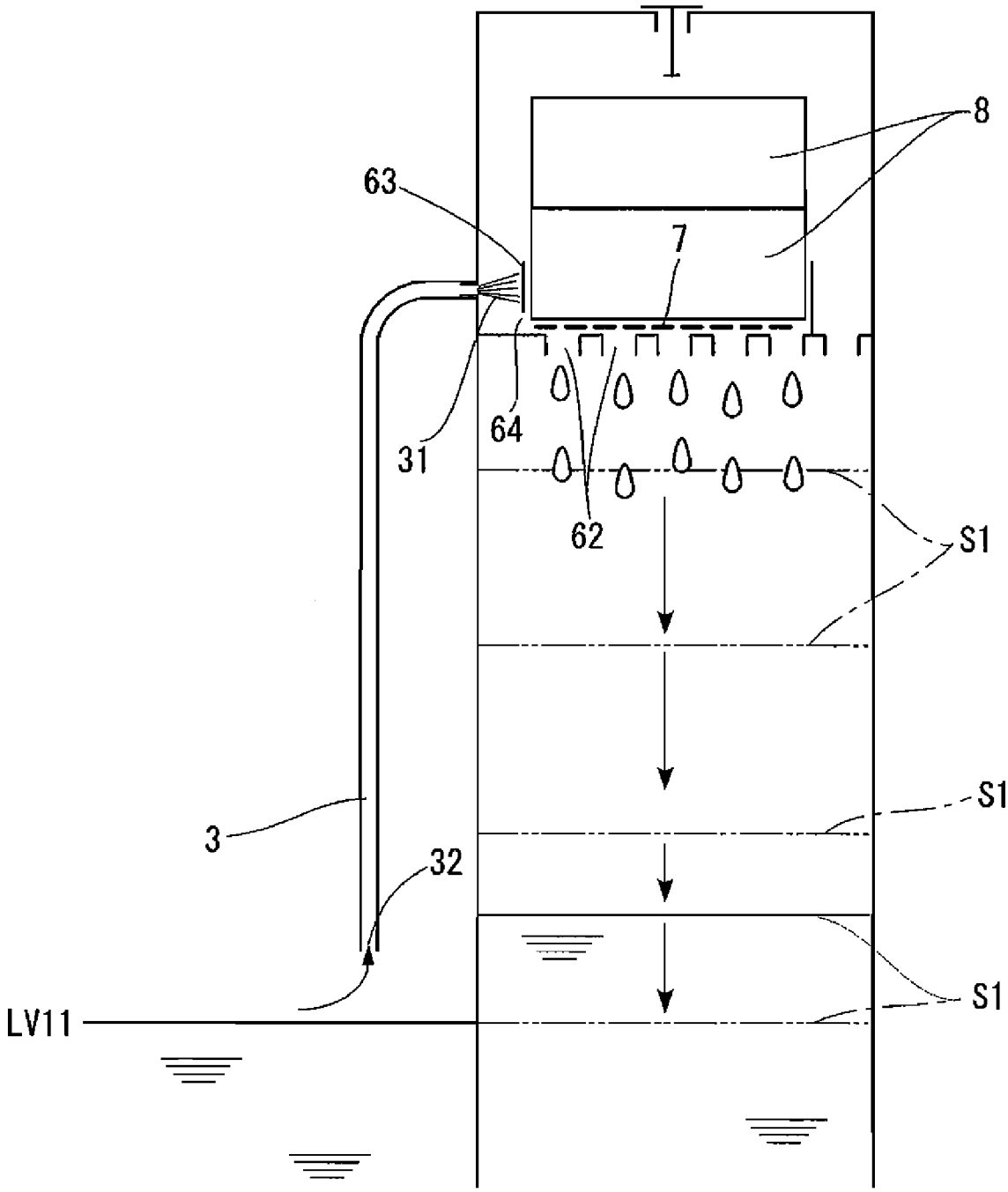
FIG. 6 is a diagram showing the state where a chemical solution drips.

When drainage from the water tank T starts, the water level in the water tank T drops as seen in FIGS. 5 and 6. Since the opening 32 is submerged until the water level in the water tank T drops to the level LV12, air cannot enter the apparatus main body 2 or the drawn-water passage tube 3, and thus neither level of the water surface S1 in the apparatus main body 2 or the water surface S2 in the drawn-water passage tube 3 changes from the level of LV13.

When the water level in the water tank T drops further than the level of LV12, the opening 32 of the drawn-water passage tube 3 appears above the water surface and is freed for air to enter. The level of the water surface S1 in the apparatus main body 2 then rapidly drops and the water in the drawn-water passage tube 3 is rapidly drawn into the apparatus main body 2 following the drop. For this reason, the drawn water jets out from the nozzle 31 and hits the guard section 63. This water then drops onto the chemical retaining section 6 and reaches the bottom surface of the chemical 8 through the water-flowing window 64 to dissolve the chemical 8. Then the chemical solutions generated by this dissolution drop from the dropping outlet 62 and are distributed in the water tank T.

Although not shown in the abovementioned embodiment, a space for setting an air freshener close to the chemical 8 may be secured or an air freshener may be set at the bottom surface of the lid body 4. When the water level in the water tank T rises and drops as mentioned above, the air inside the main body is discharged and then air is drawn in again, and thus the air inside the apparatus main body 2 is exchanged. When an air freshener is set as described above, air containing the aromatic component can be released from the apparatus main body 2.

Figure 7:
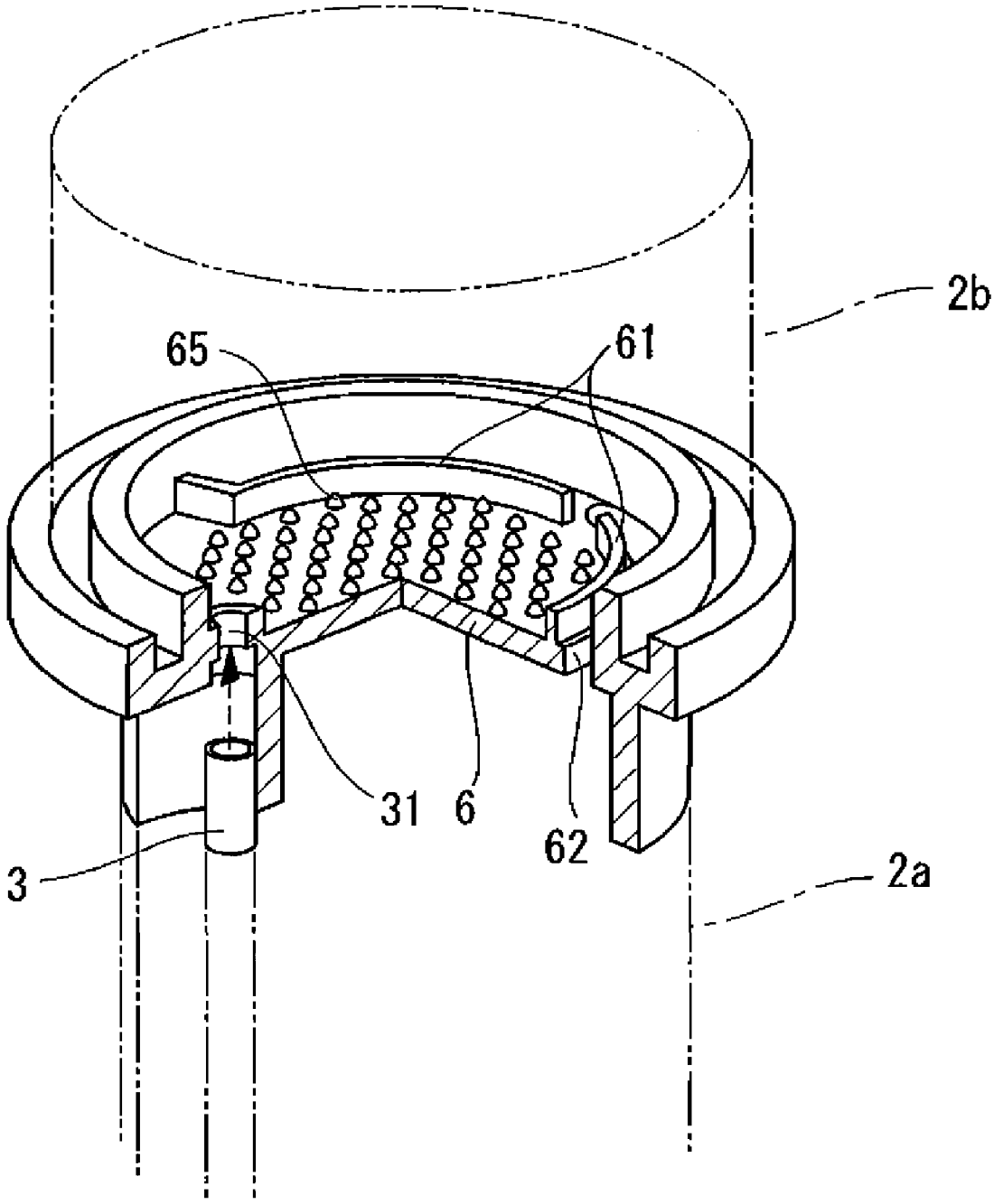
FIG. 7 is a diagram showing a chemical retaining section in another embodiment.
Figure 8:
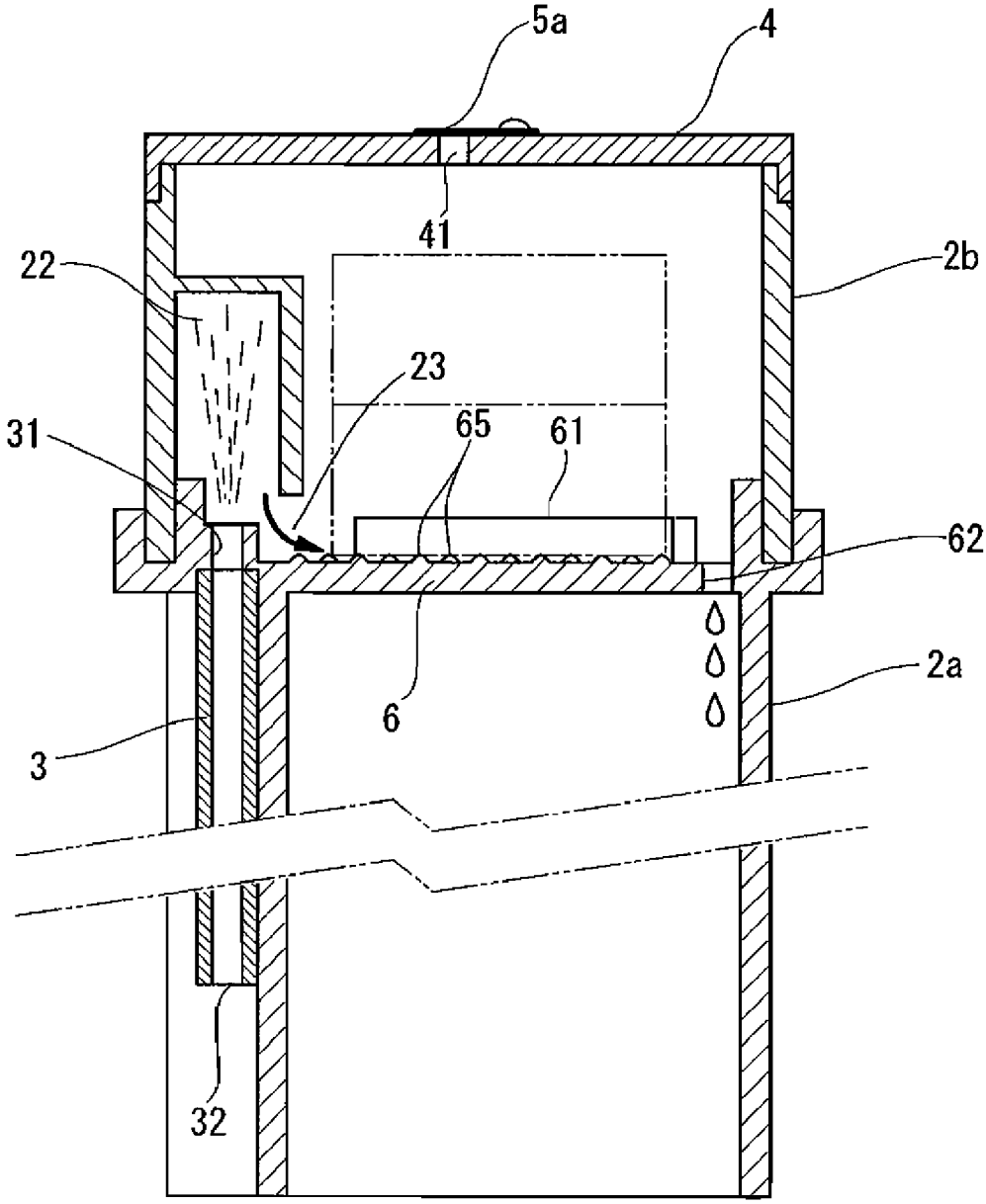
FIG. 8 is a cross sectional diagram showing a configuration of the chemical retaining section.

Note that embodiments other than the above embodiment such as that shown in FIGS. 7 and 8 may be adopted. In this embodiment, the abovementioned apparatus main body 2 is divided horizontally in two and the apparatus main body is formed by adhering a main-body lower part 2*a* and main-body upper part 2*b*. The chemical retaining section 6 is formed at the upper end part of this main-body lower part 2*a* and a dropping outlet 62 is formed outside the positioning section 61. The positioning section 61 is divided in its midstream and chemical solutions are made to flow from the inside towards the outside of the positioning section 61 through this divided part.

A plurality of protrusions 65 are formed integral to the chemical retaining section 6 inside the positioning section 61. Due to the support of the chemical 8 by these plurality of protrusions 65, a space is formed between the top surface of the chemical retaining section 6 and bottom surface of the chemical 8. A nozzle 31 is made to open facing upwards and the drawn-water passage tube 3 is attached by insertion from below the nozzle 31.

A bag-shaped space 22 is formed in the main body upper part 2*b* which is positioned above this nozzle 31 and the water jetted into the main body upper part 2*b* from the nozzle 31 enters this space 22 once. Then the water is made to flow out from a lower-part outlet 23 of the space 22 to the top surface of the chemical retaining section 6. Note that a thin film made of rubber is used as a check valve 5*a* in the present embodiment.

In addition, when installing any of the apparatus of the abovementioned embodiments in a flush tank T, it needs to be fixed to a position where the chemical 8 is not submerged when the water level in the flush tank T rises to its maximum height. It is also possible to attach a float to the outer circumference of the apparatus main body 2 or of the apparatus lower part 2*a* without fixing the apparatus to the flush tank T so that the apparatus also rises as the water level rises, and thus the chemical 8 is not submerged. However, in the case of configuring the apparatus in such a way, the apparatus may be suspended from the upper end of the flush tank T with a flexible material such as string so that the apparatus does not descend lower than a predetermined height when the water level drops due to drainage.

Figure 9:
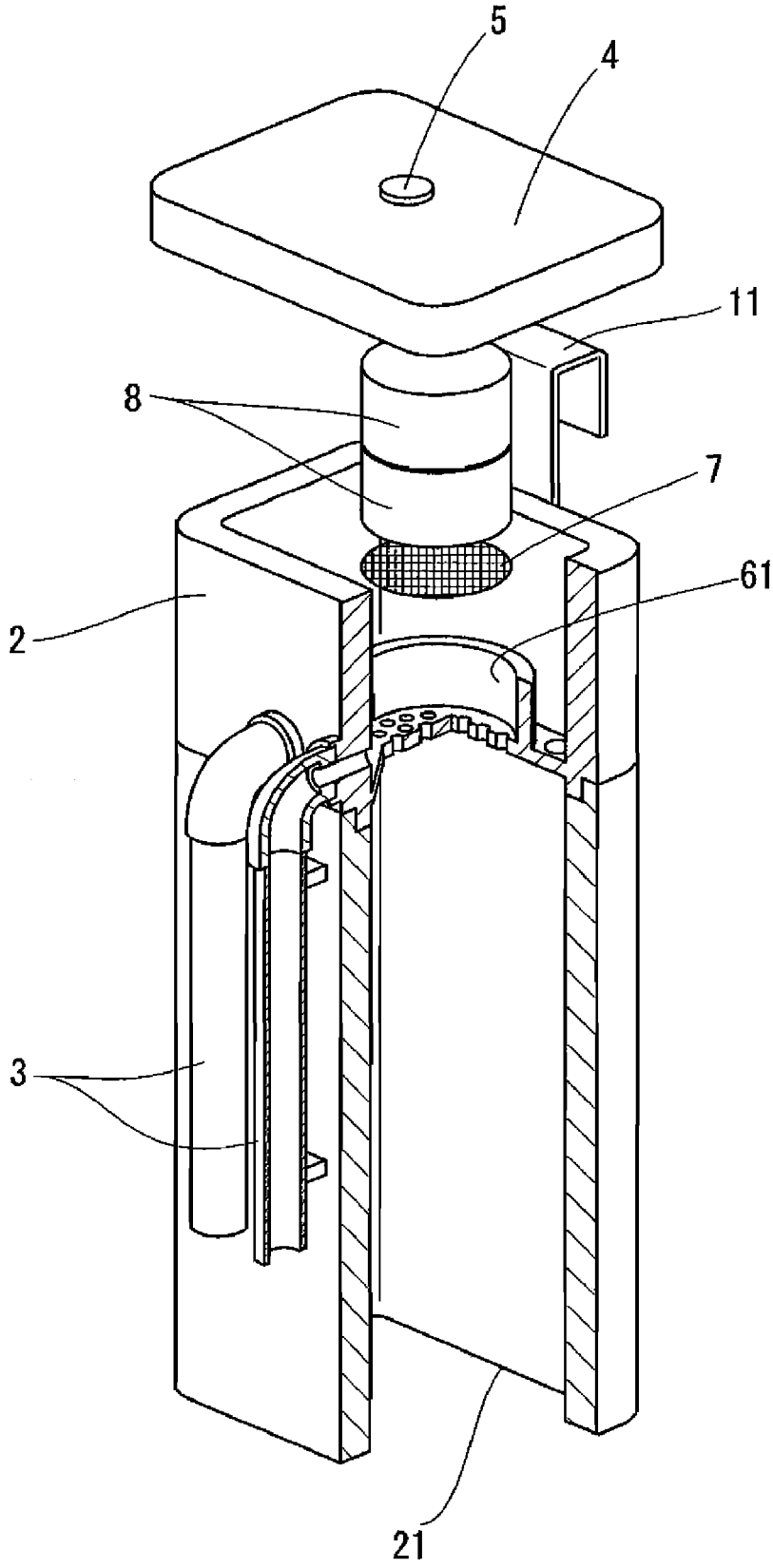
FIG. 9 is a cutaway perspective view showing a structure in another embodiment.

Note that the present invention is not limited to the abovementioned embodiment and various changes may be added thereto within a range which does not depart from the outline of the present invention. For example, as shown in FIG. 9, 2 or more of the drawn-water passage tube 3 may be provided. When a plurality of drawn-water passage tubes 3 is provided as such, the water level in the drawn-water passage tubes 3 will be low even when the flush tank T is full and the necessary amount of water can be drawn in total even though the amount of water drawn per one drawn-water passage tube 3 is low at the time of drainage. In addition, when one wants to increase the amount of water drawn, although thickening of the drawn-water passage tube 3 may result in cases where water backflows in the midst and satisfactory water-drawing cannot be achieved, the increase in the number of drawn-water passage tubes 3 can increase the amount of water drawn without generating such deficiencies.

Although the example using the chemical 8 which is a solid chemical in a narrow sense is shown in the present embodiment, cartridges in which concentrated chemical solutions are filled, as described in Japanese Laid-Open Patent Application No. 2005-61129, may be used as chemicals in a broad sense by mounting them onto the chemical retaining section 6. In addition, although the chemical retaining section 6 is made level in the abovementioned embodiment, it is also possible to improve drainage of the top surface of the chemical retaining section 6 by inclining it by approximately 5 degrees, for example.

EXAMPLES

The present invention will be described in further detail using Examples. However, the scope of the present invention is not limited by the Examples below in any way.

1) Preparation of Chemicals

Example 1

A mixed slurry of 2 weight parts of an ethylene oxide-propylene oxide block polymer (which is solid at normal temperature) which was heated and melted and 1 weight part of Food Blue No. 1 was added dropwise onto a cooled steel plate to obtain a particulate matter having a diameter of 3 mm. A mixture of 15 weight parts of this particulate matter, 74 weight parts of succinic acid, 10 weight parts of a fine powder of hydroxypropyl cellulose, and 1 weight part of a triazole-based corrosion-preventing agent was subjected to pressure molding to obtain a circular-cylinder shaped tablet having a diameter of 30 mm and height of 25 mm.

Two of the abovementioned tablets were stacked and installed in the dissolving apparatus depicted in FIG. 1 and the apparatus was placed inside a flush tank of a western-style toilet. This toilet was used by a family of a married couple with two children for 1 month and the dissolved state of tablets, amount of tablet dissolution in the 1-month time period, color tones of wash water which flows in the toilet, and the extent of dirt on the toilet (cleaning was performed once a day by merely wiping the toilet with water without the use of chemicals) was evaluated by visual observation.

Example 2

A mixture formed from 3 weight parts of an ethylene oxide-propylene oxide block polymer which is solid at normal temperature, 1 weight part of sorbitan monooleate and 2 weight parts of Food Blue No. 1 was kneaded with a doublescrew extruder and thereafter, the resulting material was cut with an extrusion length of 5 mm with a punching plate having a diameter of 2 mm to obtain a circular-cylinder shaped particulate matter. A mixture of 20 weight parts of this particulate matter, 25 weight parts of adipic acid, 45 weight parts of succinic acid, and 10 weight parts of a fine powder of hydroxypropyl cellulose was subjected to pressure molding to obtain a circular-cylinder shaped tablet having a diameter of 30 mm and height of 25 mm.

Two of the abovementioned tablets were stacked and installed in the dissolving apparatus depicted in FIG. 7 and the apparatus was placed inside a flush tank of a western-style toilet. This toilet was used and evaluated as described in Example 1.

Comparative Example 1

The contents of a chemical product (product name: Bluelet Tsurisage where "Bluelet" is a registered trademark), which is commercially available for installing inside the flush tank in a water closet and which contains a non-ionic surfactant as a major component, were heated to 90° C. to melt. This melted material was cooled to solidify after being cast into a die and a circular-cylinder shaped molded material having a diameter of 30 mm and height of 25 mm was obtained.

Two of the abovementioned molded materials were stacked and installed in the dissolving apparatus depicted in FIG. 7 and the toilet was used and evaluated as described in Example 2.

Comparative Example 2

Two of the tablets of Example 2 were stacked and installed in an empty container of the commercially available chemical "Bluelet Tsurisage" described in Comparative Example 1 (where "Bluelet" is a registered trademark) and the toilet was used and evaluated as described in Example 2.

Comparative Example 3

The toilet was used and evaluated as described in Example 2 without placing any chemical inside the flush tank.

Test results are shown in Table 1. Note that the symbols and numerical values in the table represent the following.

Variation in color tones of wash water: Visual observation of the variation degree of the concentration in color tones of wash water A: Almost no variations B: More or less satisfactory with slight variations C: Variations exist D: Unable to use toilet due to large variations Yellowing of toilet: Visual observation of the color tones of the toilet after being used for 1 month A: No yellowing B: Occurrence of slight yellowing C: Occurrence of yellowing D: Occurrence of yellowing to a high extent Amount of chemicals dissolved: Residual weight of chemical was measured after 1 month and the amount of chemicals dissolved was calculated Dissolved state of chemicals: Shape of chemical was observed at 7-day intervals.

TABLE 1

| | Variation in color tones of wash water | Yellowing of toilet | Amount of chemicals dissolved (tablets/month) | Dissolved state of chemicals |
|---|---|---|---|---|
| Ex. 1 | A | A | 1.2 | Dissolved sequentially from low part of tablets |
| Ex. 2 | B | A | 1.8 | Dissolved sequentially from low part of tablets |
| Comp. Ex. 1 | D | — | Dis-continued after 5 days | Test was discontinued since the molded material softened and high concentration of chemical passed into the flush tank |
| Comp. Ex. 2 | D | A | 6.5 | 2 tablets were additionally introduced after 9, 19, and 27 days. Pigments eluted for only 5 days after the introduction of tablets and thereafter, only tablets dissolved |
| Comp. Ex. 3 | — | D | — | |

2) Effects of Examples

As shown in Table 1, by stacking and installing the chemical of the present invention in the apparatus of the present invention and suspending the apparatus in the flush tank of a water closet where a hand-washing section is not provided, a small amount of wash water is drawn into the apparatus to contact the lowest part of the chemical which is internally installed every time the water closet is used and the water level inside the flush tank drops and dissolved liquid in which the chemical is dissolved drops to the inside of the flush tank. Since this dissolved liquid in which the chemical is dissolved slowly flows down inside the apparatus to clean the water closet, the wash water inside the tank is drained. Since the bulk of the dissolved liquid is added to wash water at the time point where wash water is pooled in the tank again, the highly-concentrated chemical solution is added to the top layer part of the wash water in the flush tank and when toilets and urinals are cleaned, they are initially cleaned with the wash water at the bottom layer in the tank where the chemical concentration is low and the wash water at the top layer in the tank containing a highly concentrated cleaning component flows in the toilets and urinals later. As a result, the filth attached to toilets and urinals is effectively removed and also toilets and urinals can be effectively cleaned due to the high concentration of the cleaning component contained in the pooled water on the surface of toilets and urinals or inside thereof.

The chemicals of the present invention are formed by compacting the surfactants or pigments which readily dissolve in water, and thus soften and deform upon contact with water, into a particulate form and by encapsulating the compacted surfactants or pigments by solid acids which do not soften upon contact with water. For this reason, active ingredients of the solid acids, surfactants, pigments or the like uniformly dissolve by the tablets contacting dissolving water for a short time only at the lowest part. Additionally, by supplying spare chemicals to the upper part, it would be possible to add various active ingredients continuously and for a long period of time to the wash water in a flush tank without the use of a special container.

In the chemicals of the present invention, solid acids prevent the attachment of calcium scale to the surface of toilets or urinals, yellowing of the surface of toilets or urinals, and generation of ammonia odor by reducing the pH value of wash water, in addition to the prevention of the attachment of solid filth by keeping the surface of toilets or urinals in favorable conditions. Surfactants improve the cleaning effect of wash water, prevent the attachment of filth to the surface of toilets or urinals, and also uniformly disperse cleaning fluids over the surface of toilets or urinals so that the effect of preventing calcium scale by solid acids would be favorable. In addition, pigments would be an indicator of the dissolution of chemicals and also give people using the toilet a refreshing feeling by coloring the wash water. Although the dissolving rate of the tablets of chemicals somewhat varied, by placing the chemical solution distributing apparatus of the present invention inside a flush tank, the attachment of calcium scale to toilets and urinals, yellowing of the surface of toilets or urinals, and the attachment of filth for 1 month were prevented. Additionally, wash water was colored light blue during the test period and pigment was dissolved almost uniformly although there was a slight variation in the concentration of color tones.

When the chemical which contained a commercially available surfactant and pigment as major components was formed into the same form as that of the chemical of the present invention and was installed in the chemical solution distributing apparatus of the present invention, even when only the lowest part of the formed product contacted dissolving water, the entirety of the installed chemical softened and lost its shape and a large amount of cleaning component flowed into the flush tank making it difficult to continue the test.

In addition, when the chemical of the present invention which was a tablet formed by covering the particulate matter of a surfactant with a solid acid was used by installing the chemical in an empty container of a chemical, which was commercially available and was used by placing inside a flush tank, in the case where toilet was not used, since tablets of the chemical were immersed in water all the time and thus a readily water-soluble pigment and surfactant dissolved after about 4 days from the start of the use of the chemical, a phenomenon where highly concentrated pigment and surfactant were eluted initially and thereafter, only solid acid was eluted for 5 to 6 days was observed. Although 2 tablets were additionally installed again after the dissolution of tablets, the dissolved state of the chemical remained the same.

Note that the present invention is not limited to the above-mentioned embodiment and various changes may be added thereto within a range which does not depart from the outline of the present invention.

INDUSTRIAL APPLICABILITY

As is apparent from the description so far, the present invention generates chemical solutions by dissolving chemicals in water of a constant amount which is drawn via a drawn-water passage section, and thus large chemical solution tanks are not required, and moreover, the amount of water drawn towards the chemicals in one cycle can be adjusted by increasing/decreasing the volume of the drawn-water passage section so that the amount of chemical solutions generated at a time can be stabilized. Moreover, since the entire apparatus is not submerged in water completely, the apparatus as a whole can be installed in a water tank in a stable position with a relatively simple mounting structure.

The invention claimed is:

1. A chemical solution distributing apparatus which is installable in a water tank of a water closet and is configured to distribute chemical solutions periodically in the water tank, the chemical solution distributing apparatus comprising:

a bottomed tubular apparatus main body having a lower end comprising an opening;

a check valve configured to allow air to be released from inside the apparatus main body to an environment outside the apparatus main body;

a chemical retaining section disposed inside the apparatus main body configured to mount or retain chemicals at a predetermined height from the opening at the lower end of the apparatus main body; and a drawn-water passage section having a first end that opens towards and is in fluid communication with an inside of the apparatus main body and a second end outside the apparatus main body and positioned higher than the lower end of the apparatus main body;

wherein the chemical solution distributing apparatus is configured so that as a water level inside the apparatus main body drops, water inside the drawn-water passage section is drawn into the inside of the apparatus main body and contacts and dissolves chemical mounted or retained by the chemical retaining section to form a chemical solution, and the chemical retaining section has at least one hole formed at an upper side of the chemical retaining section configured to allow the chemical solution to be in fluid communication with water inside the apparatus main body or inside the water tank.

2. The chemical solution distributing apparatus according to claim 1, wherein:

the check valve is located at an upper part of the apparatus main body;

the drawn-water passage section is pipe-shaped and the first end is positioned higher than the chemical retaining section so that the water inside the drawn-water passage section is drawn to a top surface of the chemical retaining section to form the chemical solution; and the at least one hole configured to allow the chemical solution to be in fluid communication with water inside the apparatus main body or inside the water tank is at least one dropping outlet defining an opening through the top surface of the chemical retaining section to and through a bottom surface of the chemical retaining section so that chemical solution present above the chemical retaining section is in fluid communication with water inside the apparatus main body present below the chemical retaining section.

3. The chemical solution distributing apparatus according to claim 1, further comprising a guard section positioned between the first end of the drawn-water passage section and a portion of the inside of the apparatus main body that may be occupied by chemical mounted or retained by the chemical retaining section, the guard section being positioned and configured to prevent water jetted from the first end of the drawn-water passage section from contacting a side surface of the chemical when the chemical is mounted or retained by the chemical retaining section.

4. The chemical solution distributing apparatus according to claim 1, wherein the chemical retaining section further comprises a plurality of protrusions from the top surface of the chemical retaining section that define a space between the top surface of the chemical retaining section and a bottom surface of the chemical when the chemical is mounted or retained by the chemical retaining section, the space being configured to distribute water which is drawn from the drawn-water passage section to the entire bottom surface of the chemical.

5. The chemical solution distributing apparatus according to claim 1, further comprising a lid portion at an upper end part of the apparatus main body and which is freely attachable and detachable so that chemical may be supplied to the chemical retaining section through the upper end part of the apparatus main body after the lid is detached.

6. The chemical solution distributing apparatus according to claim 1, wherein the apparatus is configured so that an air freshener can be mounted above the chemical retaining section.

7. A solid chemical configured for the chemical solution distributing apparatus according to claim 1, comprising a compact containing:

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

8. A solid chemical configured for the chemical solution distributing apparatus according to claim 2, comprising a compact containing:

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

9. A solid chemical configured for the chemical solution distributing apparatus according to claim 3, comprising a compact containing:

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

10. A solid chemical configured for the chemical solution distributing apparatus according to claim 4, comprising a compact containing;

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

11. A solid chemical configured for the chemical solution distributing apparatus according to claim 5, comprising a compact containing:

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

12. A solid chemical configured for the chemical solution distributing apparatus according to claim 6, comprising a compact containing:

particles of a surfactant which is solid at normal temperatures; and solid acid comprising at least one acid selected from the group consisting of fumaric acid, adipic acid, orthophthalic acid, succinic acid, maleic acid, methylene succinic acid, and boric acid.

* * * * *